US010662653B1

(12) United States Patent
Zhang

(10) Patent No.: US 10,662,653 B1
(45) Date of Patent: May 26, 2020

(54) ROOFING MATERIAL APPLICATOR USING AN ENDLESS BELT TO COLLECT AND LAY A LIQUID ROOFING SUBSTANCE

(71) Applicant: Xiuming Zhang, Winnipeg (CA)

(72) Inventor: Xiuming Zhang, Winnipeg (CA)

( * ) Notice: Subject to any disclaimer, the term of this patent is extended or adjusted under 35 U.S.C. 154(b) by 0 days.

(21) Appl. No.: 16/517,959

(22) Filed: Jul. 22, 2019

(51) Int. Cl.
*E04D 15/06* (2006.01)
*E04D 15/04* (2006.01)

(52) U.S. Cl.
CPC ..... *E04D 15/06* (2013.01); *E04D 15/04* (2013.01)

(58) Field of Classification Search
CPC ..... E04D 15/04; E04D 15/06; B29C 66/8362
USPC ..... 52/749.12
See application file for complete search history.

(56) References Cited

U.S. PATENT DOCUMENTS 2,273,599 A * 2/1942 Smith ..... E04D 15/06 425/62
3,135,430 A * 6/1964 Caldwell ..... E04D 15/06 222/626
3,222,241 A * 12/1965 Curtis ..... E04D 15/06 156/575
3,254,623 A * 6/1966 Rapp ..... E04D 15/06 118/122
2002/0029859 A1* 3/2002 Weaver ..... E04D 15/06 156/577
2006/0024133 A1* 2/2006 Shiomoto ..... E01C 23/03 404/92
2006/0037710 A1* 2/2006 Vaillancourt ..... E04D 15/04 156/574
2009/0017226 A1* 1/2009 Dyal ..... E04D 15/04 427/561
2010/0269981 A1* 10/2010 Kalwara ..... E04D 15/04 156/577
2016/0376792 A1* 12/2016 Danielson ..... E04D 15/06 52/741.1
2017/0266868 A1* 9/2017 Ralston ..... B29C 66/1122
2018/0161804 A1* 6/2018 Baker ..... B05C 11/025

* cited by examiner

*Primary Examiner* — Brian D Mattei
(74) *Attorney, Agent, or Firm* — Kyle R Satterthwaite; Ryan W Dupuis; Ade & Company Inc

(57) ABSTRACT

A roofing material applicator features a frame displaceable over a roof deck, a holding tank supported on a frame to contain a liquid roofing substance, an endless flexible belt, and a set of rotatable belt rollers around which the belt is entrained. The belt rollers include a liquid-application roller positioned for rolling movement atop the roof deck. A circuituous path around of the belt around the belt rollers passes through the holding tank so that the liquid roofing substance collects onto the belt. From the tank, the belt is routed rearwardly under liquid-application roller from a front leading side thereof. Rolling movement of the liquid-application roller during travel over the roof lays a swath of the liquid substance from the underside of the belt onto the roof deck. Sheet rollers may be included to lay a sheet of membrane or reinforcement fabric over the applied liquid swath.

15 Claims, 2 Drawing Sheets

ROOFING MATERIAL APPLICATOR USING AN ENDLESS BELT TO COLLECT AND LAY A LIQUID ROOFING SUBSTANCE

FIELD OF THE INVENTION

The present invention relates to roofing, and more particularly to tools for applying roofing membranes or coatings.

BACKGROUND

In the art of roofing, different options are known for finishing (sealing and weatherproofing) the deck surface of a roof.

One known roof finishing technique is the application of a roof coating, typically in the form of a polymeric (e.g. acrylic) composition applied to the roof in a flowable liquid state and left to dry into its hardened solid form, and often being an elastomeric composition to provide a resilient rubber-like consistency in its finished state. Acrylic roof coatings are common, but other polymeric compositions are also employed.

Among such coating-based solutions are single-coat solutions employing only the liquid coating without any additional reinforcement, and poly-coat solutions in which a layer of reinforcement fabric is laid out over a base coat of the coating substance, and then covered with a subsequent topcoat of the coating substance. The reinforcement fabric is typically provided in long spooled sheets for laying therein in strip-wise fashion over the base coat.

Another known roof finishing technique is the application of a roof membrane, for example a polymer modified bitumen membrane, which is also sold in long spooled sheets for laying thereof in strip-wise fashion over a pre-applied layer of a flowable liquid adhesive. Among such membrane-based solutions are torch-applied membranes requiring application of heat thereto as the membrane is laid out over a pre-applied layer of non-solvent adhesive to achieve proper bonding to the roof deck, and cold-applied membranes where solvent-based adhesives are used for the pre-applied adhesive layer to eliminate the need for heating of the membrane by torch or other means.

Conventional application techniques for these various roof-finishing options are labour and time intensive, with workers using manually operated hand tools to lay down the coating or adhesive, and in the instance of reinforced coatings or membranes, then manually rolling out the reinforcement fabric or membrane sheets overtop the adhesive, and in the case or torch-applied membranes, using handheld propane torches to heat the membrane during the layout process.

Canadian Patent No. 2,514,688 discloses a membrane applicator for laying out a spooled roofing membrane and includes a multi-point burner for torch-applied membranes. However, the device lacks any means for first coating the roof with adhesive.

U.S. Pat. No. 4,725,328 discloses another heater-equipped membrane applicator, which in addition to heating the membrane sheet being laid down, also heats the seams of an adjacent previously laid sheet to heat-seam the two sheets together. Again, no means for pre-coating of the roof with adhesive is included.

Additional heater equipped membrane applications are disclosed in U.S. Pat. Nos. 7,347,244 and 8,262,833, which once again lack means for first dispensing an adhesive layer on which to subsequently lay the membrane.

U.S. Pat. No. 2,500,583 discloses a machine for laying out roofing felt and applying hot tar thereto as the felt is laid out by using a spreader roller that is fed the hot tar and is biased against the spooled felt.

U.S. Pat. No. 3,222,241 discloses an apparatus for adhering a rolled sheet of vapour barrier to a roof deck. In one embodiment, adhesive is rolled onto the underside of the vapour barrier as it is spooled off the roll. In other embodiments, an adhesive reservoir has one or more openings in the bottom to gravitationally deposit adhesive on the vapour barrier or the roof deck.

U.S. Pat. No. 6,484,781 discloses an apparatus for laying roofing felt and simultaneously dispensing adhesive to the roof deck via a set of spray nozzles and a handheld touch-up wand.

U.S. Pat. No. 9,376,818 discloses another example of an apparatus for simultaneously laying a sheet of roofing material and applying adhesive in a sprayed fashion.

U.S. Pat. No. 3,625,804 discloses a method and apparatus for applying adhesive and roofing membrane material to a roof, but does so via a carriage suspended from an overhead track system, whereby the solution is only suitable for use in a manufacturing facility during production of prefabricated or modular homes.

Despite such prior attempts to simplify the roofing process, such solutions have not been widely adopted, demonstrating a need for improved and alternative solutions for simplified application of roofing materials.

SUMMARY OF THE INVENTION

According to one aspect of the invention, there is provided a roofing material applicator comprising:

a frame displaceable in a forward working direction over a roof deck to which one or more roofing substances are to be applied;

a holding tank supported on said frame for containing a volume of a liquid roofing substance thereon;

an endless flexible belt; and a set of belt rollers rotatably supported on the frame and around which said endless flexible belt is entrained to follow circuituous a path, said set of belt rollers including a liquid-application roller positioned for rolling movement atop the roof deck during travel of the frame in the forward working direction;

said set of belt rollers being positioned and configured to:

guide said endless flexible belt through the holding tank to define a collection segment of said circuituous path during which the belt collects said liquid roofing substance thereon;

guide said endless flexible belt onward from said collection segment in the holding tank to an application segment of said circuituous path at which the endless flexible belt passes rearwardly under the first applicator roller from a front leading side thereof such that rolling movement of the liquid-application roller over the roof deck during travel in the forward working direction forces a liquid-coated underside of the belt into pressured contact with the roof deck, thus transferring a swath of the liquid roofing substance onto the roof deck from the underside of the endless flexible belt.

Preferably there is provided, at a location situated between the collection and application segments of the endless flexible belt's circuituous path, a collection-thickness control device operable to remove excess collected liquid roofing substance from the endless flexible belt.

Said thickness control device may comprise a collection-thickness control roller rotatably supported in parallel relation to the set of belt rollers.

In some embodiments, a spool support is carried on the frame to support a spool of sheet material thereon, and a set of one or more sheet rollers are positioned and configured to lay said sheet material atop the laid swath of the liquid roofing substance.

In such embodiments, the collection-thickness control device may comprise one of said sheet rollers positioned in proximity to the circuituous path of the endless flexible belt so that at least some of the excess of the liquid roofing substance is skimmed from the endless flexible belt onto the sheet material.

In some embodiments, said sheet material is a roofing membrane and said liquid roofing substance is an adhesive for bonding said roofing membrane to the roof deck.

In one such membrane-applying embodiment, a heating device is placed in operable relation to a sheet-routing path on which the sheet material is directed and laid onto the swath the liquid roofing substance, whereby the sheet material is pre-heated as it is laid atop the swath of the liquid roofing substance.

In such instance, said adhesive is preferably a non-solvent adhesive.

In another embodiment for reinforced poly-coat applications, said sheet material is a reinforcement fabric and said liquid roofing substance is a liquid roof coating composition.

In such instance, said sheet rollers are preferably positioned and configured to guide said sheet material through the holding tank to impregnate the sheet material with said liquid roofing substance as the sheet material travels from the spool to a sheet-laying point at which the sheet material is laid atop the swath of the liquid roofing substance.

In spool supporting embodiments, set of sheet rollers preferably comprise a sheet-application roller that is positioned for rolling movement atop the roof deck during travel of the frame in the forward working direction, and resides in trailing relation to the liquid-application roller.

In embodiments for use in application of non-reinforced roof coatings, said liquid roofing substance is a liquid roof coating composition, and the spool support and sheet rollers may optionally be omitted since sheet material is not required for such applications. Alternatively, the spool support and sheet rollers may be included on the machine to allow use of the same machine for both reinforced and non-reinforced roof coatings.

Preferably, at a location trailing the liquid-application roller, there is an application-thickness control device positioned and operable to skim excess applied liquid roofing substance from above the roof deck.

In poly-coat embodiments, the application-thickness control device is preferably positioned to skim said excess applied liquid roofing substance from a topcoat thereof above the reinforcement fabric.

Preferably, said application-thickness control device comprises a levelling blade.

Preferably there is a belt cleaner positioned in trailing relation to the liquid-application roller and in adjacency to the circuituous path of the endless flexible belt, and operable to remove remnant liquid roofing substance therefrom.

BRIEF DESCRIPTION OF THE DRAWINGS

Preferred embodiments of the invention will now be described in conjunction with the accompanying drawings in which.

DETAILED DESCRIPTION

Figure 1:
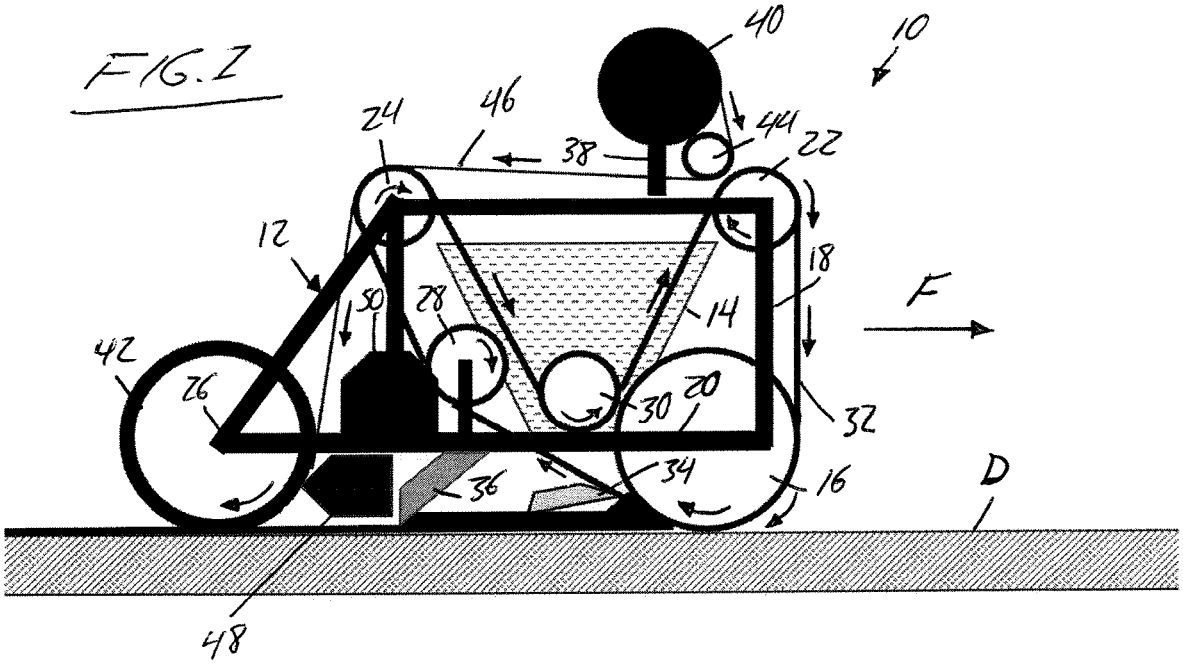
FIG. 1 is a schematic side elevational view of a first embodiment roofing material applicator configured for application of a liquid non-solvent adhesive to a roof deck, and simultaneous laying and heating of a conventionally torch-applied roofing membrane over the applied adhesive.

FIG. 1 shows a first embodiment roofing material applicator 10 featuring a frame 12 conveyable in a forward working direction F over the surface of a roof deck D. On the frame is supported a holding tank 14 for storing a volume of a liquid roofing substance therein. In the present embodiment, the liquid roofing substance is a non-solvent adhesive usable with conventionally torch-applied roofing membranes that require heating thereof as they are laid atop the roof deck D.

A set of belt rollers are rotatably supported on the frame for rotation about their respective horizontal axes, which lie parallel to one another in perpendicular relation to the forward working direction F in which the frame travels over the roof deck D. The belt rollers include a liquid-application roller 16 situated at or adjacent a leading front end 18 of the frame at a lower elevation than the other belt rollers, for example being rotatably supported between two parallel bottom side rails of the frame (one of which is shown at 20) that lie parallel to the forward working direction F at opposing sides of the frame. The low elevation of the liquid-application roller 16 places it in suitable position for rolling motion atop the roof deck D, thus contributing to rolling support of the frame on the roof deck. In addition to this liquid-application roller 16, the belt rollers include an upper front belt roller 22 residing in elevated relation above the liquid-application roller 16 at or near the front end 18 of the frame 12, an upper rear belt roller 24 residing at similar elevation to the upper front belt roller 22, but in opposite and trailing relation thereto in the forwarding working direction F, thus residing closer to a rear end 26 of the frame 12.

The belt rollers also include a lower rear belt roller 28 situated in trailing relation to the liquid-application roller 16 and at a lower elevation than the rear upper belt roller 24, and finally a submerged belt roller 30 situated inside the holding tank 14 near the closed bottom end thereof at a position situated between the liquid-application roller 16 and the lower rear roller 28 in the forward working direction. An endless flexible belt 32 is entrained around the set of belt rollers, and follows a circuituous path therearound. This starting circuituous path, starting from the upper front quadrant of the upper rear belt roller 24 spans obliquely forward and downward therefrom into the holding tank 14 via an opening at the top end thereof, from which the belt continues downwardly and forwardly toward the submerged belt roller 30, at which the belt then wraps around the lower quadrants of said submerged belt roller 30. The belt 32 then spans obliquely upward and forward from the lower front quadrant of the submerged belt roller 30 to re-emerge from the top of the holding tank, from which the belt then wraps over the upper quadrants of the upper front belt roller 22. From here, the belt 32 spans downward to the liquid-application roller 16, and wraps around the underside thereof from a position leading the roller 16 at the front lower quadrant thereof, to a position trailing the roller 16 at the rear lower quadrant thereof. From here, the belt 32 angles upwardly and rearwardly to the lower rear belt roller 28, where it wraps upwardly about the lower rear quadrant thereof. The belt then angles upwardly and rearwardly to the upper rear belt roller 24, where it wraps over the upper rear quadrant thereof, thereby completing the endless circuituous path around the set of belt rollers.

At least one of the belt rollers is a driven roller, the driven rotation of which thus causes the belt to move through the above described circuituous path in the above described direction. In one example, the liquid-application roller 16 is a motor-driven roller, the rotation of which therefore performs or contributes to both travel of the apparatus 10 over the roof deck D in the forward working direction F, and entrained movement of the belt 32 around the set of belt rollers. The segment of the belt's circuituous path that passes through the holding tank is submerged in the liquid substance stored in the holding tank, at least where the belt wraps under the submerged belt roller 30 near the bottom of the tank. The belt 32 therefore collects the liquid substance thereon as the belt travels through this submerged segment of the circuituous path.

As shown, the interior of the holding tank may have a downwardly tapered shape delimited between downwardly converging front and rear tank walls. The narrower lower portion of the tank interior is substantially occupied by the submerged roller 30, whereby the liquid in the wider upper portion of the tank is funneled toward the submerged roller 30 to ensure coating of the belt passing therearound as the liquid is depleted over time. Further along the circuituous path at an application segment thereof, the belt 32 passes under the liquid-application roller 16, and so the collected liquid substance on the underside of the belt is thus brought into contact with the roof deck D over which the liquid-application roller 16 is travelling. The rolling contact of the liquid-application roller 16 with the topside of the belt applies downward pressure thereon, thus pressing the liquid-coated underside of the belt against the roof D so that the collected liquid substance (in this case, the non-solvent adhesive) on the belt's underside, or at least a partial thickness of the collected liquid thereon, is transferred to the roof deck D. This roller 16 is thus co-operable with the belt 32 to lay a swath of the liquid substance on the roof deck, hence the labelling of this roller as the "liquid-application roller".

In the illustrated embodiment, a belt cleaning device 34, for example in the form of a scraping blade spanning the full width of the belt in a transverse direction parallel to the rotational axes of the belt rollers, is supported on the frame 12 in relatively close trailing relation to the liquid-application roller 16 at an elevation just beneath, but in close or contacting relation to, the upwardly and rearwardly angled segment of the belt's path between the liquid-application roller 16 and the lower rear belt roller 28. This segment is referred to herein as a return segment, as it is here that the belt begins its return to the holding tank 14 from the liquid-application roller 16 to pick up more of the liquid substance. A working edge of the cleaning blade 34 resides in contacting or closely adjacent relation to the underside of the belt at this return segment of the belt path, and is thus operable to scrape remnant collected liquid roofing substance from the underside of the belt. In trailing relation behind the cleaning blade 34 is a thickness-control blade 36 carried on the frame 12 in a downwardly reaching orientation placing a working edge of this blade 36 in closely spaced relation to the roof deck D to skim excess accumulated adhesive from the roof deck, and thereby impart a uniform predetermined thickness to the laid-down swath of adhesive.

The forgoing explanation of how the liquid substance is collected on the belt and then applied therefrom to the roof deck D likewise applies to the additional embodiments discussed herein further below, and so duplication of this same description for those other embodiments is omitted in the interest of brevity.

Still referring to FIG. 1, the first embodiment is operable not only to apply the swath of liquid roofing substance, which in this instance is a non-solvent adhesive, but is also operable to lay a roofing membrane over the swath of adhesive. For such purposes, a spool support 38 is mounted to the frame 12 to carry a spool 40 of roofing membrane in a position placing the spool axis parallel to the axes of the belt rollers. A set of sheet rollers are rotatably carried on the frame 12 to route the spooled sheet of roofing membrane on a predetermined path from the spool support 38 down to the roof deck for laid placement atop the laid swath of adhesive. The axes of the sheet rollers are parallel to the those of the belt rollers. The sheet rollers include a sheet-application roller 42 situated at or adjacent the trailing rear end 26 of the frame at a relatively low position of similar or equal elevation to the liquid application roller 16, and in opposing and trailing relation thereof in the forward working direction F. Accordingly, whereby the both of these application rollers 16, 42 are positioned for rolling motion over the roof deck D, and thereby cooperatively enable the rolling movement of the frame 12 thereover. The other sheet-roller is a guide roller 44 situated closely adjacent and in leading relation to the lower front quadrant of the spool 40.

The membrane sheet 46 is guided along a predetermined routing path from the spool 40 to the sheet-application roller 42, first unwinding from the spool 40 at the leading front side thereof down to the guide roller 44, where the membrane sheeting 46 wraps around the front lower quadrant of the guide roller, and then spans rearwardly therefrom to the upper rear belt roller 24, where the membrane sheeting wraps over the upper rear quadrant thereof in sliding relation over the belt 32. From here, the membrane sheeting 46 runs downwardly to the lower front quadrant of the sheet-application roller 42, and wraps rearwardly thereunder for pressured application of the membrane sheeting onto the adhesive swath on the roof deck. The sliding interface at which the membrane sheeting 46 and the belt 32 slide past one another in opposite directions at the upper rear quadrant of the upper rear belt roller 24 allows any remaining remnant liquid adhesive that remains on the belt downstream of the belt cleaner to be brushed onto the underside of the membrane sheeting 46 at it slides over the belt. Accordingly, the upper rear belt roller 24 has multiple purposes: guiding movement of the belt into the holding tank, guiding movement of the sheeting 46 toward the sheet-application roller 42 at the rear end of the frame, and applying a pre-coat of adhesive to the underside of the sheeting 46 before laying thereof onto the adhesive coated roof deck.

The first embodiment is useful for roofing membrane compositions that are conventionally torch-applied, and therefore includes a heating device 48 mounted to the frame at a relatively low position, for example suspended beneath the same side rails 20 to which the two application rollers 16, 42 are rotatably journaled. The heating device 48 resides in closely adjacent and leading relation to the sheet-application roller 42, for example at the lower front quadrant thereof in trailing relation to the thickness-control blade 36. The heating device 48 is therefore operable to apply heat to the membrane sheet 46 just upstream of where the sheet 46 is pressed onto the roof deck D by the sheet-application roller 42. The heating device may be of any suitable type capable of providing sufficient heat to the membrane over the full width thereof, for example a multi-point burner like that of aforementioned U.S. Pat. No. 7,347,244, or an infra-red heater like that of aforementioned U.S. Pat. No. 8,262,833, each of which is incorporated herein by reference in its entirety. The use of infra-red or other flameless heating configuration may be preferable for improved safety. For operating an infra-red or other electrically powered heater 48, an onboard electrical generator 50 may be carried on the frame 12, in which case an electrical motor may also be powered by the generator 50 for the purpose of driving the liquid-application roller 16.

Like the upper rear belt roller 24 that doubles as a guide roller and adhesive applicator for the membrane sheeting 46, the guide roller 44 that rearwardly redirects the membrane sheeting 46 as it unwinds from the spool 40 likewise serves multiple purposes. In one sense, it serves as a collection-thickness control device for controlling the thickness of collected liquid carried on the side of the belt 32 from which the liquid will be applied to the roof deck D. The guide roller 44 is positioned closely adjacent the upper front belt roller 22, and so the gap space between these two rollers 22, 44 limits the thickness of collected liquid that can pass through this gap on the side of the belt that faces the sheet-routing guide roller 44 as the belt passes over the upper front belt roller 22. Though facing upward at this location, this side of the belt will later face downward at the application segment of the circuituous belt path that passes under the liquid-application roller 16. Accordingly, thus topside of the belt on which the guide roller 44 acts as a collection-thickness control device equates to the underside of the belt from which the liquid is applied to the roof deck at beneath the liquid-application roller 16. Also, since the membrane sheeting 46 is routed about the lower front quadrant of the guide roller 44 that faces the upper front belt roller 22, the excess collected liquid skimmed off the belt by the closely adjacent guide roller 44 is wiped onto the underside of the membrane sheeting 46 as it feeds off the spool 40 and around the guide roller 44. Accordingly, like the sliding belt/sheet interface at the upper rear belt roller 24 that applies remnant adhesive from the belt onto the membrane sheet, the gap space or nip between the guide roller 44 and the front upper belt roller 22 serves as an adhesive applicator for the underside of the sheet membrane, but in this case uses excess collective adhesive on the belt as it freshly emerges from the holding tank 14, thus also controlling the thickness of collected adhesive on the belt 32 that is fed onward to the liquid-application roller 16.

Figure 2:
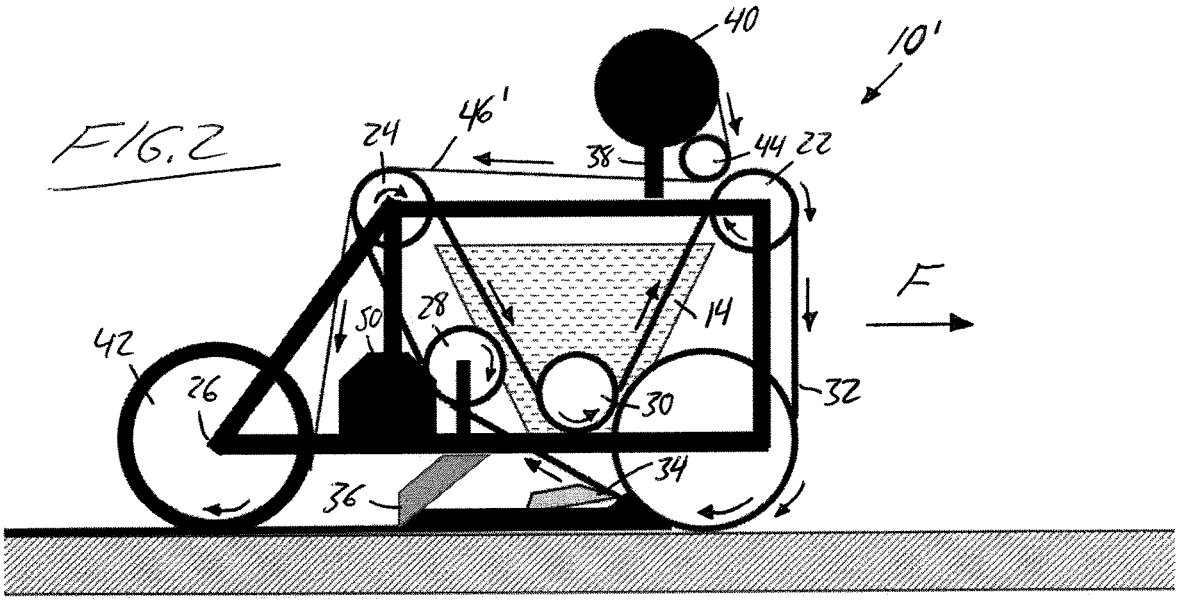
FIG. 2 is a schematic side elevational view of a second embodiment roofing material applicator configured for application of a liquid solvent-based adhesive to a roof deck, and simultaneous unheated laying of a roofing membrane over the applied adhesive in non-heated fashion.

FIG. 2 shows a second embodiment roofing material applicator 10' that employs the same frame, spool support, belt rollers, sheet rollers, holding tank, blade cleaner, thickness-control blade, and generator as the first embodiment, and differs from the first embodiment solely in the lack of heating device 48 and the use of a solvent-based adhesive in the holding tank 14 to ensure bonding of a compatible membrane sheet 46' without the need to apply heat thereto.

Figure 3:
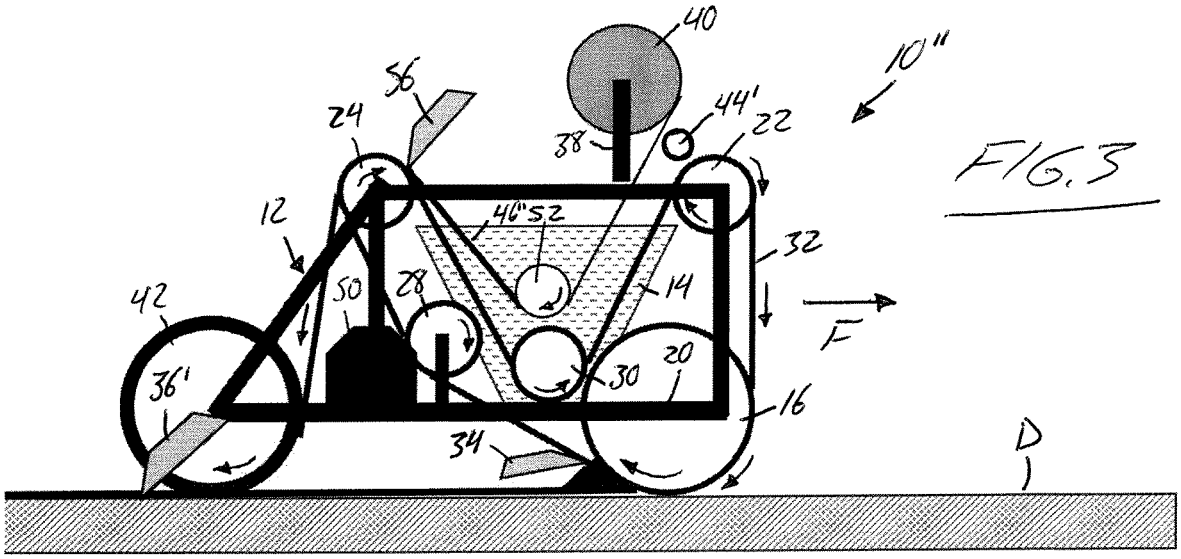
FIG. 3 is a schematic side elevational view of a third embodiment roofing material applicator for poly-coat applications, thus configured to apply an initial base coat of liquid roof coating composition to the roof deck, and simultaneously impregnate a sheet of reinforcement fabric with the same composition and lay the impregnated sheet over the initiate coat.

FIG. 3 shows a third embodiment roofing material applicator 10" that employs the same frame, spool support, belt rollers, sheet-application roller, holding tank, blade cleaner, and generator as the first and second embodiments. The heating device of the first embodiment is again omitted like in the second embodiment. The third embodiment differs rom the preceding two however, in that the thickness control blade 36 is moved to a different location, and the set of sheet rollers features an additional roller omitted in the earlier embodiments, specifically a submerged sheet-roller 52 residing inside the holding tank 14 in elevated relation above the submerged belt roller 30. Accordingly, the sheet material 46" from the spool 40 in this embodiment is routed through the holding tank 14 to also collect liquid therefrom, just like the belt 32. In this embodiment, the sheet material 46" is not a roofing membrane, and the liquid substance is not an adhesive. Instead, this embodiment is used for a poly-coat roofing application, where the sheet material 46" is a reinforcement fabric, and the liquid substance is a roof coating composition (e.g. elastomeric roof coating) to be laid on the roof deck in a manner embedding the reinforcement fabric therein. The belt rollers and the endless flexible belt entrained therearound cooperate in the same manner as the preceding embodiments, but instead of laying a swath of adhesive, lay a base coat of the roof coating composition over which the sheet of reinforcement fabric is subsequently lain by the sheet-application roller 42. Since the reinforcement fabric is intended to form an embedded intermediate layer in the in the finished roof coating, not a finishing topmost layer like the membrane sheeting of the earlier embodiments, the sheet rollers route the reinforcement sheeting 46" through the liquid-containing holding tank 14 to impregnate the reinforcement sheeting with the liquid composition before laying it atop the base layer laid by the belt and liquid-application roller 16.

While a roller 44' is present at the same location as the guide roller 44 of the earlier embodiments for the same purpose of performing thickness control on the belt-collected liquid, the sheeting 46" is not routed around this roller 44' in the present embodiment. Accordingly, this roller is referred to as a thickness control roller 44' in the present embodiment. Application of excess collected liquid from the belt to the sheeting 46" is not needed at this roller 44' in the present embodiment, because the routing of the reinforcement sheeting 46" through the holding tank 14 means both sides of the sheeting 46" will be thoroughly coated regardless of the availability of any excess collected liquid on the belt 32. The thickness-control roller 44' may be replaced by a skimming blade in this embodiment since its used only to control the collected thickness of liquid on the belt 32, and not as a liquid-transfer roller for applying the excess liquid to the sheet material. Since this blade would control the thickness of collected liquid on the belt, as opposed to controlling the applied thickness of liquid on the roof deck like the thickness control blade 36 described above, these two blades may be distinctively referred to as a collection-thickness control blade for controlling collected thickness on the belt, and an application-thickness control blade 36 for controlling applied thickness on the roof deck. Since a roller may be used for thickness control instead of a blade, the more general terms collection-thickness control device and application-thickness control device are also used herein to encompass various options for skimming off excess liquid from the belt and the roof deck.

The reinforcement sheeting 46" angles downwardly and rearwardly from the front lower quadrant of the rotatably supported spool 40 into the holding tank 14 through a shared or discrete opening in the top end thereof, and continues at this angle down to the lower front quadrant of the submerged sheet roller 52, where the sheeting 46" wraps under the submerged sheet roller 52 to the lower rear quadrant thereof. From here, the sheet 46" angles upwardly and rearwardly to emerge from the top of the tank toward the upper front quadrant of the upper rear belt roller 24, at which the sheeting 46" wraps over the oppositely-moving belt 32 at the upper quadrant of this roller 24, then spans downwardly to the sheet-application roller 42 to pass thereunder for pressured application of the sheeting 46" onto the adhesive swath already laid on the roof deck D. The sheeting 46", having been impregnated with the liquid roof coating composition at the holding tank 14, forms both a reinforcement layer and an overlying topcoat of the roof coating composition.

The application-thickness control blade 36' in this embodiment is shifted rearward from earlier embodiments so as to reside in trailing relation to the sheet-application roller's lowermost point (i.e. the point of its pressured contact with the sheeting 46" and underlying roof deck), whereby the working edge of the thickness control blade 36' rides over the laid sheeting material 46" to level out the sheeting and impregnated topcoat to a uniform thickness. In addition to the collection-thickness control device 44' acting on the belt 32, an additional collection-thickness control device 56, for example in the form of another blade, acts on the topside of the impregnated sheeting 46" above its point of emergence from the holding tank 14 near the upper front quadrant of the upper rear belt roller 24. The additional collection-thickness control device 56 thus skims off excess collected liquid on the topside of the sheeting 46" before the sheeting is routed under the sheet-application roller 42.

Figure 4:
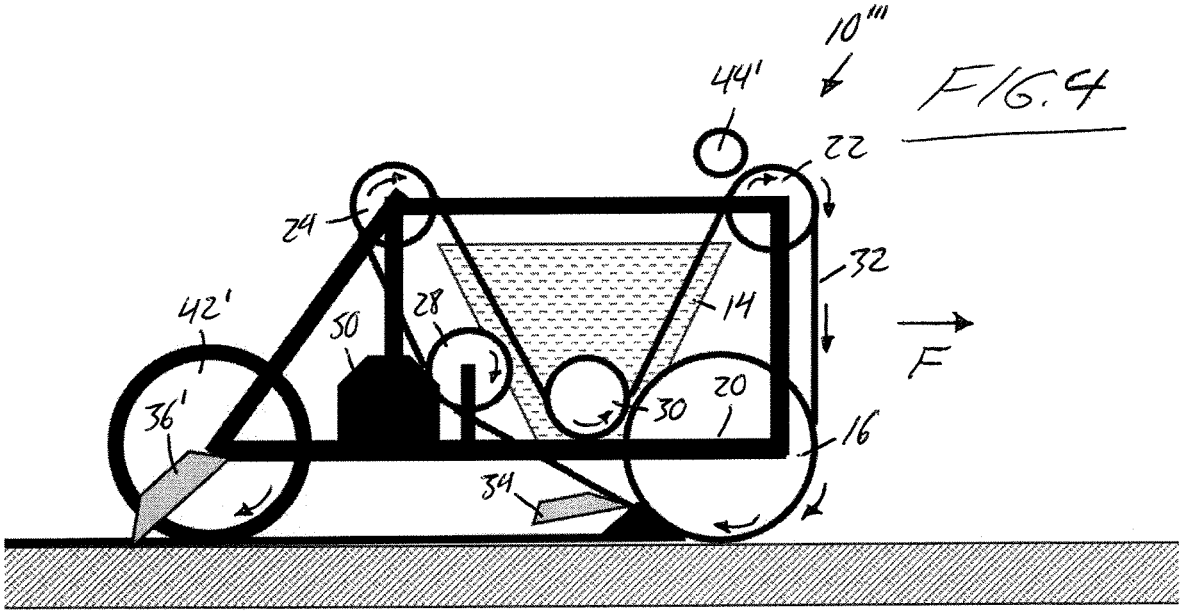
FIG. 4 is a schematic side elevational view of a simplified fourth embodiment roofing material applicator for non-reinforced roof coating applications, thus configured to apply a coat of the liquid coating composition to the roof deck without any subsequent sheet of reinforcement fabric.

Finally, FIG. 4 shows a fourth embodiment roofing material applicator 10''' which features the same frame, belt rollers, holding tank, blade cleaner, application-thickness control device, collection-thickness control device and generator 50 as the third embodiment, but lacks the spool holder, sheet rollers and additional collection-thickness control device. The fourth embodiment is used solely to apply a liquid roof coating composition to the roof deck using the belt 32 and cooperating belt rollers in the manner described above. In this embodiment, the roller 42' that rolls movement over the roof deck at or near the rear end of the frame is not used for application of sheet material to the roof deck, but once again cooperates with the liquid-application roller 16 for rolling support of the frame, and therefore may be referred to as a support roller, or a smoothing or compacting roller, as it rides over the swath of roof coating composition laid out by the liquid-application roller 16 and therefore, with the accompanying application-thickness control blade 36', may help contribute to the controlled level uniform thickness if the roof-applied liquid composition.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A roofing material applicator comprising:

a frame displaceable in a forward working direction over a roof deck to which one or more roofing substances are to be applied;

a holding tank supported on said frame for containing a volume of a liquid roofing substance thereon;

an endless flexible belt; and a set of belt rollers rotatably supported on the frame and around which said endless flexible belt is entrained to follow circuituous path, said set of belt rollers including a liquid-application roller positioned for rolling movement atop the roof deck during travel of the frame in the forward working direction;

said set of belt rollers being positioned and configured to:

guide said endless flexible belt through the holding tank to define a collection segment of said circuituous path during which the belt collects said liquid roofing substance thereon;

guide said endless flexible belt onward from said collection segment in the holding tank to an application segment of said circuituous path at which the endless flexible belt passes rearwardly under the first applicator roller from a front leading side thereof such that rolling movement of the liquid-application roller over the roof deck during travel in the forward working direction forces a liquid-coated underside of the belt into pressured contact with the roof deck, thus transferring a swath of the liquid roofing substance onto the roof deck from the underside of the endless flexible belt.

2. The applicator of claim 1 comprising, at a location situated between the collection and application segments of the endless flexible belt's circuituous path, a collection-thickness control device operable to remove excess collected liquid roofing substance from the endless flexible belt.

3. The applicator of claim 2 wherein said collection-thickness control device comprises a thickness control roller rotatably supported in parallel relation to the set of belt rollers.

4. The applicator of claim 3 further comprising a spool support carried on the frame to support a spool of sheet material thereon, and a set of one or more sheet rollers positioned and configured to lay said sheet material atop the laid swath of the liquid roofing substance, wherein the collection-thickness control device comprises one of said sheet rollers positioned in proximity to the circuituous path of the endless flexible belt so that at least some of the excess of the liquid roofing substance is skimmed from the endless flexible belt onto the sheet material.

5. The applicator of claim 1 further comprising a spool support carried on the frame to support a spool of sheet material thereon, and a set of sheet rollers positioned and configured to lay said sheet material atop the laid swath of the liquid roofing substance.

6. The applicator of claim 4 in combination with said liquid roofing substance and said spool of sheet material, wherein said sheet material is a roofing membrane and said liquid roofing substance is an adhesive for bonding said roofing membrane to the roof deck.

7. The applicator of claim 6 further wherein said adhesive is a non-solvent adhesive, and the applicator further comprises a heating device placed in operable relation to a sheet-routing path on which the sheet material is directed and laid onto the swath the liquid roofing substance, whereby the roofing membrane is pre-heated as it is laid atop the swath of the liquid roofing substance.

8. The applicator of claim 4 further comprising a heating device placed in operable to relation a path set forth by the sheet rollers to guide laying of said sheet material onto the swath the liquid roofing substance, whereby the sheet material is pre-heated as it is laid atop the swath of the liquid roofing substance.

9. The applicator of claim 4 in combination with said liquid roofing substance and said spool of sheet material, wherein said sheet material is a reinforcement fabric and said liquid roofing substance is a liquid roof coating composition.

10. The applicator of claim 9 wherein said sheet rollers are positioned and configured to guide said sheet material through the holding tank to impregnate the sheet material with said liquid roofing substance as the sheet material travels from the spool to a sheet-laying point at which the sheet material is laid atop the swath of the liquid roofing substance.

11. The applicator of claim 4 wherein said set of sheet rollers comprise a sheet-application roller that is positioned for rolling movement atop the roof deck during travel of the frame in the forward working direction, and resides in trailing relation to the liquid-application roller.

12. The applicator of claim 1 in combination with said liquid roofing substance, wherein said liquid roofing substance is a liquid roof coating composition.

13. The applicator of claim 1 comprising, at a location trailing the liquid-application roller, an application-thickness control device positioned and operable to skim excess applied liquid roofing substance from above the roof deck.

14. The applicator of claim 13 wherein said application-thickness control device comprises a levelling blade.

15. The applicator of claim 1 comprising a belt cleaner positioned in trailing relation to the liquid-application roller and in adjacency to the circuituous path of the endless flexible belt, and operable to remove remnant liquid roofing substance therefrom.

* * * * *